US008684061B2

(12) United States Patent
Porter, IV

(10) Patent No.: US 8,684,061 B2
(45) Date of Patent: Apr. 1, 2014

(54) CONFINED SPACE CONTROL COVER

(75) Inventor: Thomas J Porter, IV, League City, TX (US)

(73) Assignees: Merlina Bajrami Porter, League City, TX (US), part interest; Thomas Jefferson Porter, IV, League City, TX (US), part interest ( * ) Notice: Subject to any disclaimer, the term of this patent is extended or adjusted under 35 U.S.C. 154(b) by 75 days.

(21) Appl. No.: 13/220,644

(22) Filed: Aug. 29, 2011

(65) Prior Publication Data

US 2013/0025202 A1 Jan. 31, 2013

Related U.S. Application Data

(60) Provisional application No. 61/511,523, filed on Jul. 25, 2011.

(51) Int. Cl.

| | |
|---|---|
| ***E06B 5/00*** | (2006.01) |
| ***E06B 5/10*** | (2006.01) |
| ***E05B 55/00*** | (2006.01) |
| ***E02D 29/14*** | (2006.01) |

(52) U.S. Cl.
USPC ..... 160/10; 150/154; 52/20; 404/25

(58) Field of Classification Search
USPC ..... 150/154, 166; 383/5; 52/20; 401/25; 220/319.32, 287; 404/25; 49/13; 160/10
See application file for complete search history.

(56) References Cited

U.S. PATENT DOCUMENTS

| | | | | |
|---|---|---|---|---|
| 1,375,480 | A * | 4/1921 | West | 150/154 |
| 4,315,535 | A * | 2/1982 | Battle | 206/335 |
| 4,449,715 | A * | 5/1984 | Gagas | 277/625 |
| 4,664,975 | A * | 5/1987 | Kobayashi | 428/323 |
| 5,167,267 | A * | 12/1992 | McQuaid | 150/166 |
| 5,431,474 | A * | 7/1995 | Burkey | 296/100.15 |
| 5,431,553 | A * | 7/1995 | Topf, Jr. | 425/11 |
| 5,496,128 | A * | 3/1996 | Odill | 404/25 |
| 5,653,492 | A * | 8/1997 | Mills | 296/136.04 |
| 5,664,975 | A * | 9/1997 | Carlisle | 440/49 |
| 5,727,351 | A * | 3/1998 | Neathery et al. | 52/20 |
| 5,842,811 | A * | 12/1998 | Johnson | 404/25 |
| 5,890,919 | A * | 4/1999 | Geisler | 439/134 |
| 5,899,024 | A * | 5/1999 | Stannard | 52/20 |
| 5,913,479 | A * | 6/1999 | Westwood, III | 24/298 |
| 6,464,425 | B1 * | 10/2002 | Closkey | 404/26 |
| 6,485,086 | B2 * | 11/2002 | McGrath, Jr. | 296/136.13 |
| 6,887,012 | B1 * | 5/2005 | Zappe | 404/25 |
| 7,677,193 | B2 * | 3/2010 | Roark et al. | 114/361 |
| 2006/0213911 | A1 * | 9/2006 | Settles | 220/287 |
| 2007/0113490 | A1 * | 5/2007 | Boyd | 52/133 |

* cited by examiner

*Primary Examiner* — Sue A Weaver

(74) *Attorney, Agent, or Firm* — Bushman & Associates, P.C.

(57) ABSTRACT

A confined space control cover that covers a man-way to a confined space area that includes a polyester base cover and an attachment perimeter orifice that covers the man-way, a heavy nylon strapping with two ends that is utilized to secure the confined space control cover over the man-way and a plurality of steel eyelets that are disposed on both ends of the strapping. A lock is placed through the eyelets on both ends to secure the control cover to the man-way. The control cover also includes a warning sign disposed on the front of the base cover to prevent persons from entering the confined space area and a maintenance tag that is attached to the strapping to indicate maintenance activity performed near or within the confined space area or man-way.

9 Claims, 2 Drawing Sheets

CONFINED SPACE CONTROL COVER

This application claims priority to U.S. Provisional Application 61/511,523 filed on Jul. 25, 2011, the entire disclosure of which is incorporated by reference.

TECHNICAL FIELD & BACKGROUND

There is currently a plurality of confined space control devices available that address confined space areas. Even with the usage of the confined space control devices that are currently available, there are still hundreds of fatalities and injuries that occur in the chemical and refining industries as well as other heavy industries annually. Also, these confined space control devices are being manipulated and removed by unauthorized personnel. These individuals are sometimes entering the confined space without the proper authorization and are becoming casualties or persons with serious injuries. With the proper usage of our lockable confined space covers, any and all individuals would have to get authorization from the key holder prior to entering the space. In most cases, the key holder is the atmospheric tester and/or responsible party for the confined space being secured and locked-out. In addition to this lockable confined space control cover working to keep persons from entering a confined space without authorization, it also provides an excellent barrier from water, dust and other elements. The lockable confined space control cover will also be manufactured with an optional ventilated fabric/mesh facing, which will provide the user with the same level of protection while still meeting their need for proper ventilation for the confined space.

The present invention relates to a lockable confined space cover that can be incorporated into OSHA's current lock-out tag-out procedure. More specifically, the present invention relates to a waterproof and/or ventilated lockable confined space control cover.

It is an object of the present invention to provide a confined space control cover that is placed and securely locked over any confined space man-way that is on a tower, a vessel, a tank or other confined space control location or area.

It is an object of the present invention to provide a confined space control cover that can be locked and secured until any testing (including atmospheric testing) is done.

It is an object of the present invention to provide a confined space control cover that eliminates any possibility of an individual being able to break the plain of a confined space.

What is really needed is a confined space control cover that is placed and securely locked over any confined space manway that is on a tower, a vessel, a tank or other confined space control location or area that can be locked and secured until any testing (including atmospheric testing) is done that eliminates any possibility of an individual being able to break the plain of the confined space.

BRIEF DESCRIPTION OF THE DRAWINGS

The present invention will be described by way of exemplary embodiments, but not limitations, illustrated in the accompanying drawing in which like references denote similar elements, and in which:

FIG. 1 B illustrates an environmental side perspective view of a confined space control cover, in accordance with one embodiment of the present invention.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
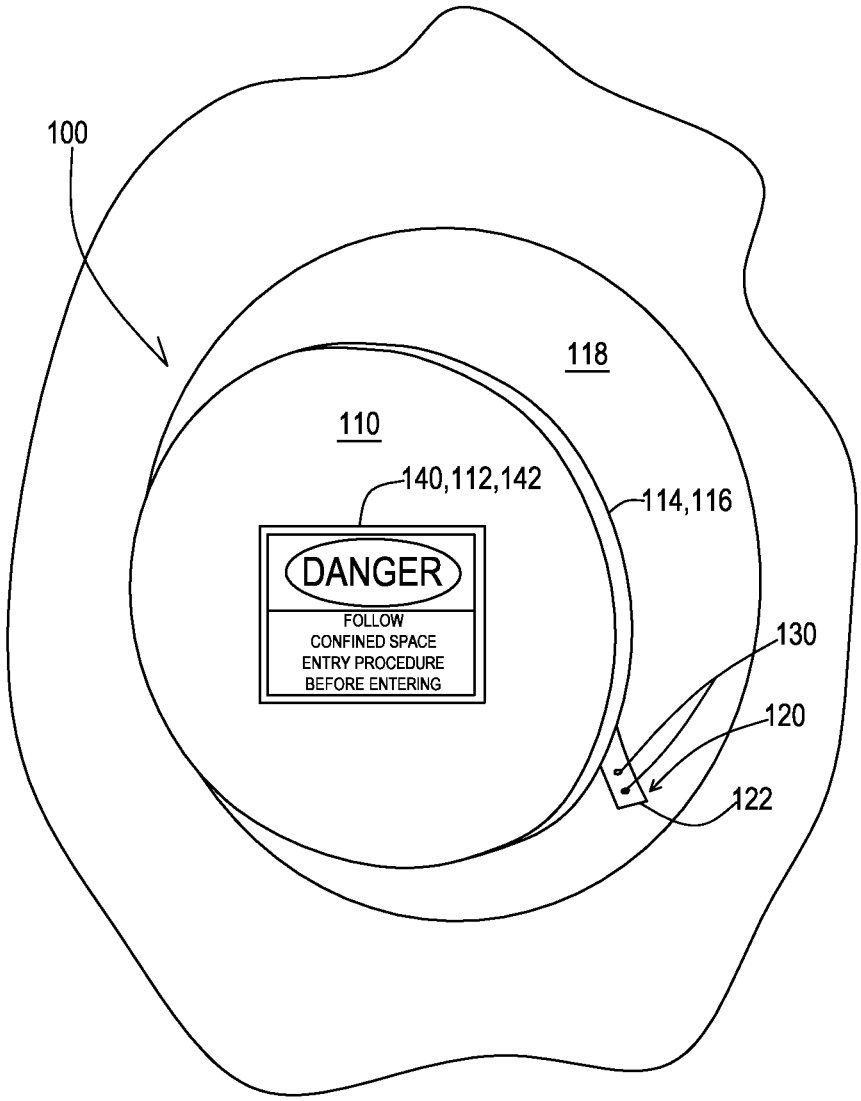
FIG. 1 A illustrates an environmental front perspective view of a confined space control cover, in accordance with one embodiment of the present invention.

FIG. 1 A illustrates a front perspective view of a confined space control cover 100, in accordance with one embodiment of the present invention. The confined space control cover 100 includes a base cover 110, a strapping 120, a plurality of eyelets 130 and a warning sign 140.

The base cover 110 with a front 112, a rear attachment opening 114 and a peripherally extending channel 116 covers a man-way 118 to warn and indicate persons in the surrounding area that a confined space area (not shown) is secured and locked-out. The man-way 118 leads directly to the confined space area. The base cover 110 is made of chemical resistant fabric that will be manufactured in either a solid waterproof fabric or a ventilated fabric/mesh. Although the base cover 110 can be made of other suitable types of fabric and material as well. The strapping 120 is made of heavy nylon material that is utilized to secure the confined space control cover 100 over the manway 118. The strapping 120 is placed through the peripherally extending channel 116. Channel 116 has channel opening 117, preferably on the interior of the base cover. Both ends 122,124 of strapping 120 extend from channel opening 117 such that ends 122, 124 are exposed outside the base cover 110. The result of this design is that when the ends 122, 124 of strapping 120 are pulled, the outer peripheral portion of the cover is pulled inwards resulting in an outer peripheral diameter that is smaller than the inner portion of the base cover 110. Thus, the confined space control cover 100 can be placed over manways of varying size and be secured around the manway 118. This eliminates the need for specially sized covers for each manway. The strapping 120 can also be made of other suitable material as well. The eyelets 130 are disposed on both ends 122,124 (FIG. 1B) of the strapping 120 to accommodate a lock 132 (FIG. 1B) that is utilized to secure both ends 122,124 of the strapping 120 around and over the manway 118. The eyelets 130 are made of steel although the eyelets 130 can be made of any other suitable material as well. The warning sign 140 is typically disposed on the front 112 of the base cover 110, although the warning sign 140 can be disposed anywhere on the base cover 110. The warning sign 140 is typically an occupational safety and health administration or OSHA or other safety regulatory agency sign 142 although the warning sign 140 can be any suitable safety warning sign. More specifically, the warning sign 140 says "DANGER CONFINED SPACE AREA" or other suitably related confined space warning sign wording.

Figure 1B:
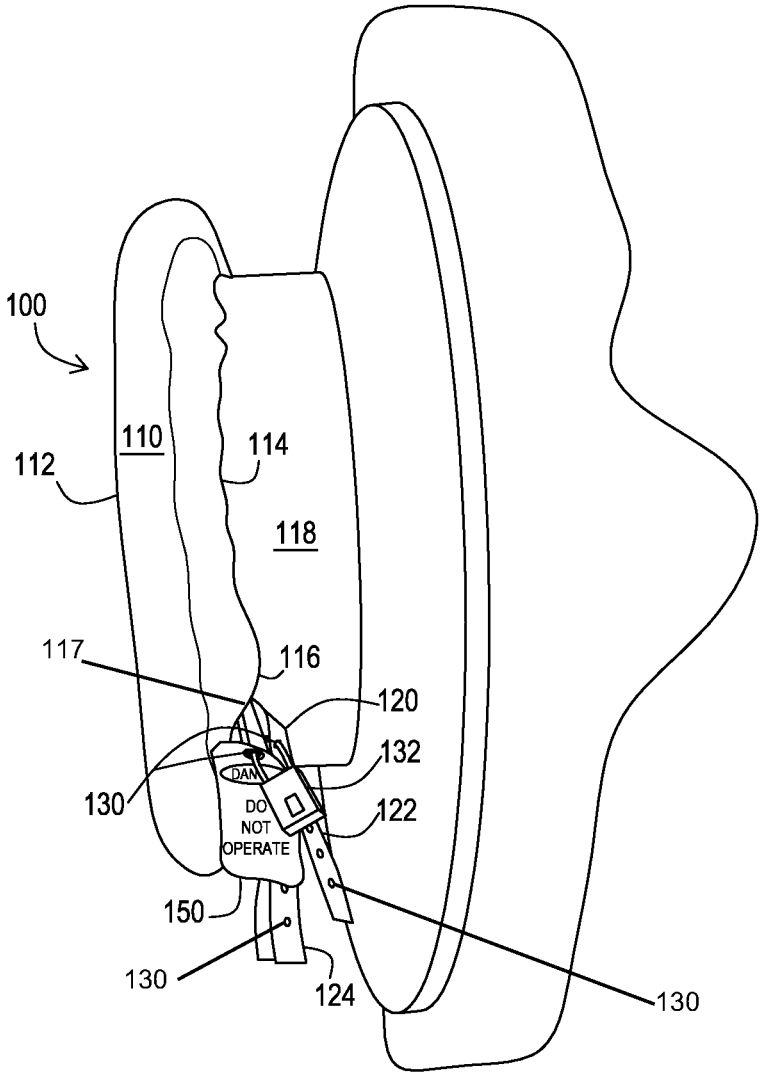

FIG. 1B illustrates a side perspective view of a confined space control cover 100, in accordance with one embodiment of the present invention.

The confined space control cover 100 further includes a maintenance tag 150. The maintenance tag 150 is attached to the strapping 120 to provide an additional warning to one or more persons near or within the confined space area or man-way 118.

The confined space control cover is placed and securely locked over any confined space man-way that is on a tower, a vessel, a tank or other confined space control location or area that can be locked and secured until any testing (including atmospheric testing) is done that eliminates any possibility of one or more persons being able to break the plane of the confined space.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A cover for restricting access to a manway to a confined space area comprising:

a one-piece base cover having a exterior surface and an interior surface, said cover including an innermost portion having a first diameter and a peripheral outermost portion having a second diameter, said peripheral outermost portion having formed therein a peripherally extending channel, said peripherally extending channel having a channel opening;

a strap received in said channel, said strap having a first end and a second end, said first and second ends extending out of said channel opening, whereby when said first end of said strap and said second end of said strap are pulled out of said channel opening of said channel, the second diameter of said peripheral outermost portion of said cover becomes smaller than the first diameter of the innermost portion of said cover;

at least one eyelet in said first end of said strap and a plurality of spaced eyelets in said second end of said strap.

2. The cover according to claim 1, further comprising:

a warning sign disposed on said exterior surface of said base cover.

3. The cover according to claim 2, wherein said warning sign is an OSHA sign.

4. The cover according to claim 2, wherein said warning sign says danger confined space area.

5. The cover according to claim 1, wherein said base cover is made of waterproof chemical resistant fabric or chemical resistant breathable fabric.

6. The cover according to claim 1, wherein said strap is made of heavy nylon material.

7. The cover according to claim 1, wherein said eyelets accommodate a lock that is utilized to secure said both ends of said strap around and over said manway.

8. The cover according to claim 1, further comprising:

a maintenance tag that is attached to said strap to indicate maintenance activity performed near or within said confined space area or said man-way.

9. The cover according to claim 1, wherein said channel opening is on said interior surface of said cover.

* * * * *